US006921262B2

(12) United States Patent
Fate

(10) Patent No.: US 6,921,262 B2
(45) Date of Patent: Jul. 26, 2005

(54) BURNER MANIFOLD APPARATUS AND METHOD FOR MAKING SAME

(75) Inventor: Dan Fate, Grafton, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 0 days.

(21) Appl. No.: 10/628,835

(22) Filed: Jul. 28, 2003

(65) Prior Publication Data

US 2005/0026101 A1 Feb. 3, 2005

(51) Int. Cl.[7] ..... F23D 14/62
(52) U.S. Cl. ..... 431/354; 431/353
(58) Field of Search ..... 431/353, 354; 29/890.08, 890.052; 138/89, 94

(56) References Cited

U.S. PATENT DOCUMENTS

| | | | | |
|---|---|---|---|---|
| 3,672,020 A | | 6/1972 | Freggens | |
| 4,721,456 A | | 1/1988 | Granberg et al. | |
| 4,745,967 A | | 5/1988 | Kern | |
| 4,930,459 A | | 6/1990 | Coffenberry | |
| 4,971,142 A | | 11/1990 | Mergler | |
| 5,277,577 A | * | 1/1994 | Schachter et al. | 431/344 |
| 5,379,830 A | | 1/1995 | Itoh | |
| 5,450,667 A | | 9/1995 | Gire | |
| 5,481,800 A | | 1/1996 | Hutto et al. | |
| 5,586,600 A | | 12/1996 | Cribari | |
| 5,649,588 A | | 7/1997 | Lee | |
| 5,799,397 A | | 9/1998 | Yasuda et al. | |
| 5,868,198 A | | 2/1999 | Kato | |
| 5,947,196 A | | 9/1999 | Halm et al. | |
| 5,979,430 A | * | 11/1999 | Peed et al. | 126/39 N |
| 6,056,047 A | | 5/2000 | Gowan | |
| 6,237,638 B1 | * | 5/2001 | Asta et al. | 137/883 |
| 6,482,000 B2 | * | 11/2002 | Sestrap | 431/353 |

OTHER PUBLICATIONS

Photograph A–sectioned manifold tube end with a cup–shaped element installed.
Photograph B–cup–shaped element prior to insertion into the end of the manifold tube.

* cited by examiner

*Primary Examiner*—Jiping Lu
(74) *Attorney, Agent, or Firm*—Watts Hoffmann Co, LPA

(57) ABSTRACT

A method and apparatus for sealing the end of a burner tube including the step of forming a bore near the end of the burner tube and inserting a cone-shaped plug element into the bore until a circular periphery of the plug element abuttably engages a step defined by the stepped bore. The circular periphery of the plug element has a diameter that is greater than an inside diameter of the step formed by the stepped bore. A force is then applied to the plug element tending to cause its circular periphery to expand radially outwardly until the circular periphery sealingly engages the inside of the stepped bore. The sealing method and apparatus allows various processing steps to be performed on the tube, such as bending, drilling, painting and punching to be performed prior to sealing the end of the tube.

5 Claims, 2 Drawing Sheets

BURNER MANIFOLD APPARATUS AND METHOD FOR MAKING SAME

TECHNICAL FIELD

The present invention relates generally to gas burners and, in particular, to an improved burner manifold and method for making the manifold.

BACKGROUND ART

Burner manifolds used in gas fired appliances, such as furnaces and boilers should be leak free in order to inhibit the uncontrolled escape of gas. Leaks in the burner system may result in inefficient combustion, undesirable fumes and possible gas ignition hazards.

Prior art constructions generally consist of a tube bent into a predetermined shape. In general, the shape is a function of the combustion chamber in which the manifold is mounted. Typically, one end of the tube includes a means for connecting to a control valve that controls the communication of a combustible gas to the tube. The opposite end of the tube is generally sealed. Gas communicated to the tube is generally discharged through apertures formed in the tube which may include burner nozzles. The gas discharged through the apertures/nozzles is burned to produce heat.

In prior art constructions, the end of the tube opposite the control valve is generally sealed using a friction welding technique. In general, this process involves mounting the tube in a chuck and spinning it at high speed while bringing a heat resistant bit in contact with the end. The contact between the bit and the end of the tube creates heat and bends the material inwardly ultimately forming a welded end seal.

Although the prior art process for sealing a tube is generally effective, it must be performed on a straight tube and before other processing steps, such as painting, punching, tapping and bending are performed. It has been found that at times it can be difficult to remove slugs from hole punching operations, chips from tapping operations and other dirt and debris from the tube once the one end is sealed. Moreover, washing of the tube prior to painting can also be difficult since with one end sealed, draining of the tube is inhibited, especially if the tube is bent prior to the washing/painting step.

DISCLOSURE OF INVENTION

The present invention discloses a new and improved burner manifold for use in a gas fired appliance, such as a furnace or boiler, as well as a method for constructing the improved manifold tube.

According to the invention, the burner manifold includes a tube segment having an open end that is to be sealed. To effect the seal, the tube segment includes a stepped bore at its opened end that defines a step having an inside diameter smaller than the diameter of the bore. A plug member defining a circular periphery with a diameter smaller than the diameter of the bore, but larger than the inside diameter of the step is used to seal tube end. The plug member abuttably engages the step and has a periphery that is expanded radially outwardly to sealing engage an inside of the end bore. The plug member is preferably cone shaped and has an apex that protrudes outwardly with respect to the end opening of the tube when the plug member is first inserted into the tube end.

According to the preferred method for sealing the open end of a tube segment that forms part of a burner manifold, an end bore is formed in the tube end that terminates at a step. A plug member having a circular periphery with a diameter less than the diameter of the end bore, but larger than an inside diameter of the step is then inserted into the tube end until it abuttably engages the step. A force is then applied to the plug member in order to cause its circular periphery to expand outwardly in order to sealingly engage the inside of the end bore. The force for expanding the periphery is preferably applied to the plug member by a cylindrical tool that is inserted into the end bore and is reciprocally actuated in order to exert hammering forces to the plug member whereby deformation is induced in the plug member to cause its circular periphery to expand radially outwardly. In alternate methods, a nonreciprocating or constant force may be applied to the plug member to produce the required deformation.

Additional features of the invention will become apparent and a fuller understanding obtained by reading the following detailed description made in connection with the accompanying drawings.

BEST MODE FOR CARRYING OUT THE INVENTION

Figure 1:
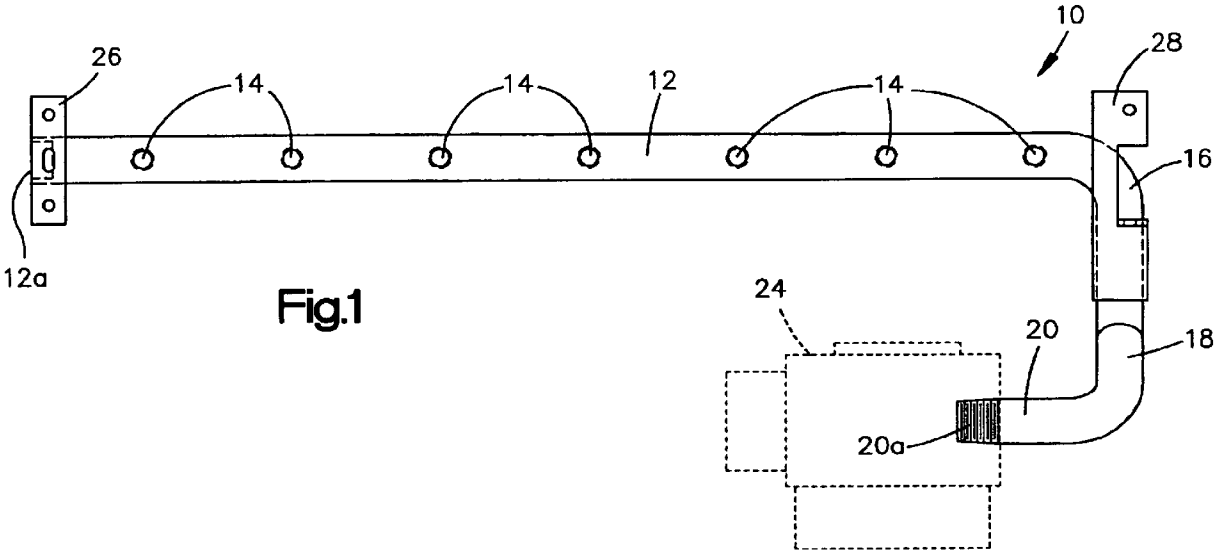
FIG. 1 is a top elevational view of a burner manifold tube constructed in accordance with the preferred embodiment of the invention.
Figure 2:
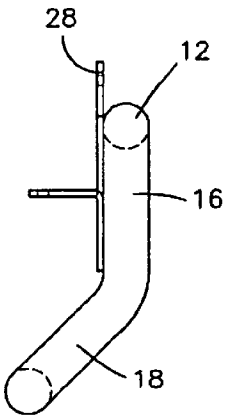
FIG. 2 is an end view of the tube shown in FIG. 1.
Figure 3:
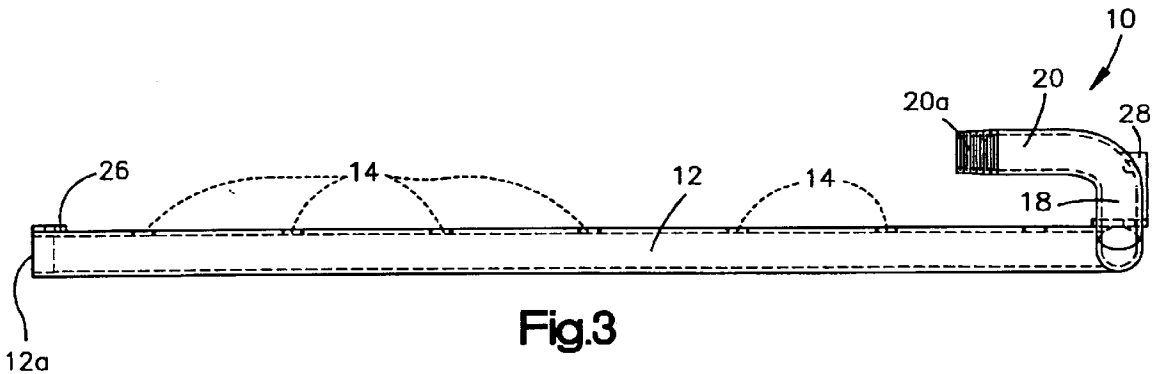
FIG. 3 is a side elevational view of the tube shown in FIG. 1.

FIGS. 1–3 illustrate a manifold tube 10 that forms part of a manifold assembly constructed in accordance with the preferred embodiment of the invention. The illustrated tube 10 includes a substantially straight burner segment 12 which terminates in an open end 12*a*. The burner segment 12 includes a plurality of apertures 14, preferably threaded apertures, which are adapted to receive burner nozzles (not shown) through which a combustible gas is discharged and burned.

The illustrated burner tube includes a first intermediate segment 16 oriented 90° with respect to the burner segment 12. A second intermediate segment 18 is oriented 45° with respect to the first intermediate segment 16. The burner tube 10 terminates in an inner segment 20 which in the illustrated embodiment includes a threaded end 20*a* by which a manifold valve assembly 24 (shown in phantom) can be threadedly attached. In the illustrated embodiment, the inner end segment 20 is oriented 90° with respect to the second intermediate segment and extends in a direction that is parallel to the burner segment 12.

In the preferred embodiment, the tube 10 is bent into the illustrated shape using known bending methods. Mounting brackets 26, 28 are suitably attached (as by welding, brazing, etc.) to the burner segment 12 and the first intermediate segment 16, respectively and serve as a means for mounting the tube 10 (and attached control valve 24) within a combustion chamber (not shown) forming part of a gas fired appliance, such as a gas fired furnace or boiler. In use, a combustible gas such as natural gas is communicated to the tube 10 via the manifold valve 24 (which is connected to a gas source). The end 12*a* of the manifold tube 10 must be sealed in order to prevent the escape of gas from the tube 10 and to assure that the all gas is discharged through the burner nozzles.

As indicated above, past constructions utilize a friction welding technique to seal the end of the manifold tube. The prior friction welding process involves spinning the tube 10 and using a tool to create friction on the tube end 12*a* to force material at the end of the tube to bend inwardly and then fuse due to heat generated between the spinning tube and a stationary tool.

Figure 4:
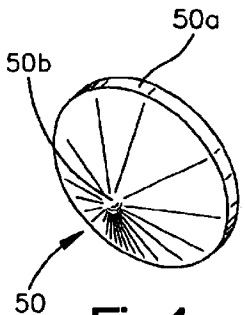
FIG. 4 is an elevational view of a plug used to seal one end of the tube shown in FIG. 1, constructed in accordance with the preferred embodiment of the invention; and, FIGS. 5–8 illustrate, somewhat schematically, the process steps that are performed in order to seal one end of the tube shown in FIG. 1.

According to the invention, the end 12*a* of the tube 10 is sealed using a plug 50 illustrated in FIG. 4. The illustrated method for sealing the end 12*a* of the tube 10 can be effected after virtually all processing of the tube 10 has been completed including, but not limited to, bending of the tube to its final shape, the forming of the burner nozzle bores 14 (which may comprise a punching and/or drilling/tapping operation), painting of the tube and attachment of the mounting brackets. In prior art fabrication methods, which utilize friction welding techniques to seal or close the end of the manifold tube, the tube sealing step must be performed before most, if no all, of the above enumerated operations, i.e., bending, painting, punching, etc. According to the preferred method for making the illustrated tube 10, the bending, punching, drilling/tapping, and painting operations and attendant cleaning operations are all performed prior to sealing of the tube end 12*a*. As a result, any contaminants, metal shavings, etc. can be removed or cleansed from the tube 10 prior to sealing the tube end 12*a*.

Turning now also to FIGS. 5–8, the preferred method for sealing the end of the tube 12*a* is illustrated. In particular, a plug 50, shown in FIG. 4 is used to seal the end 12*a* of the tube. The plug 50 is preferably cone-shaped and preferably stamped from suitable sheet metal. It may be made of corrosion resistant material or plated in order to inhibit corrosion.

Figure 5:
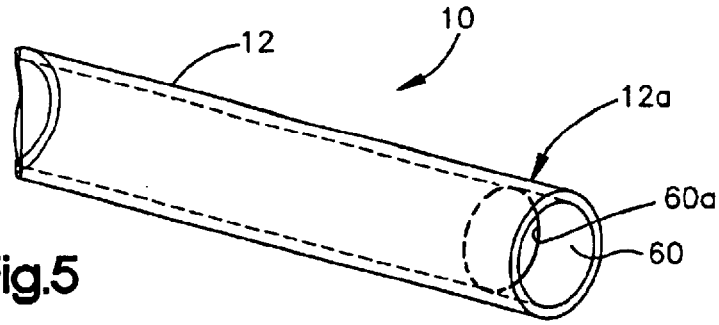

As seen in FIG. 5, a uniform bore segment 60 is formed on the inside of the end 12*a* by a suitable tool, such as a drill. The bore 60 preferably has a uniform wall finish and defines a step 60*a*. In its uninstalled or free state, the plug 50 preferably has circular periphery 50*a* that has a diameter slightly smaller than a diameter D' of the bore 60, but greater than an inside diameter D of the step 60*a* (see also FIG. 8). This allows the plug 50 to be easily inserted into the bore 60 until its periphery 50*a* abuttably engages the step 60*a* as shown in FIG. 7.

Figure 6:
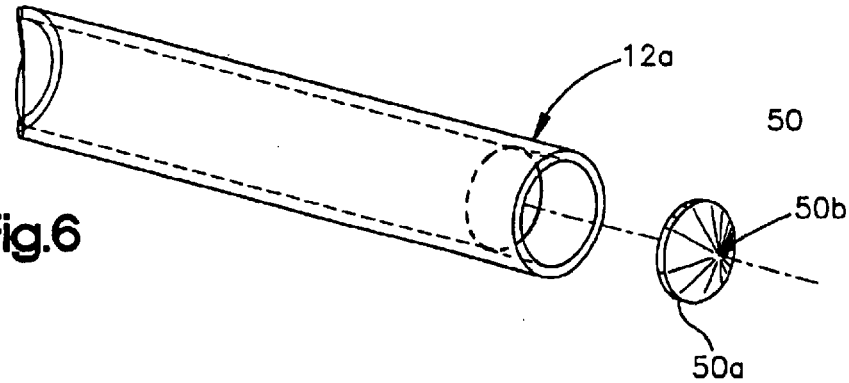
Figure 7:
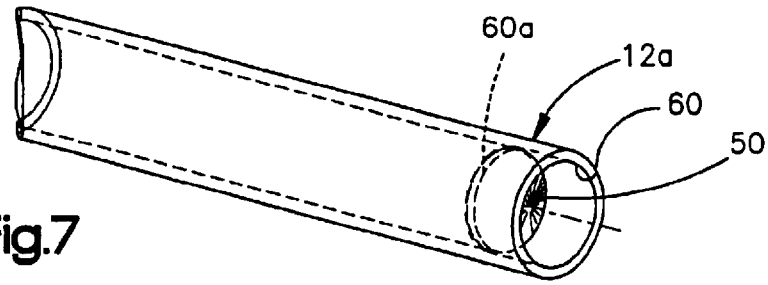
Figure 8:
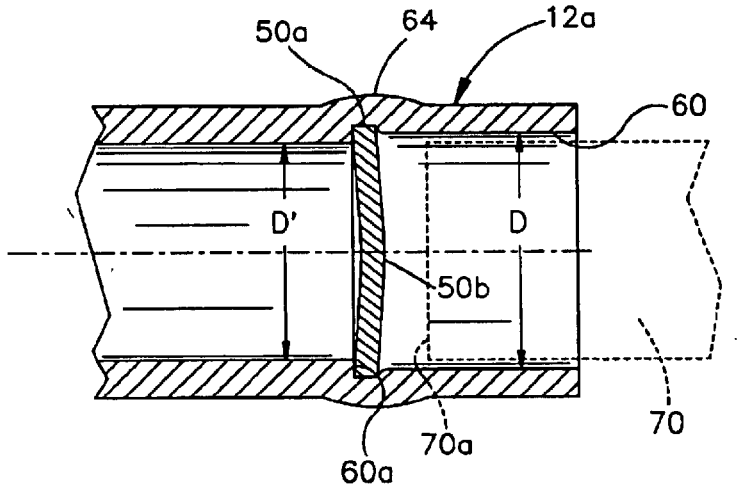

To seal the end 12*a* of the tube segment 12, the plug 50 is inserted into the bore 60 with a point or apex 50*b* of the cone oriented toward the outside of the tube (as shown in FIGS. 6 and 7). A force is then applied to the plug 50 to cause its circular periphery 50*a* to move radially outwardly in order to sealingly engage the inside of the bore 60. The force is applied to the apex 50*b*. Since the circular periphery abuts the step 60*a*, movement of the plug 50 in the axial direction within the bore 60 is inhibited. As a result, the cone-shaped plug tends to flatten in response to the application of force to the apex 50*b*. This "flattening" urges the circular periphery 50*a* to move radially outwardly with sufficient force to form a seal between the circular edge 50*a* and the inside of the bore surface. This is preferably accomplished without the use of any additional sealing material. The final orientation and shape of the plug within the bore 60 is shown in FIG. 8. It should be noted that in the preferred embodiment, sufficient force is applied to the cone-shaped plug in order to move its circular edge 50*a* outwardly to a final diameter that is slightly greater than the diameter D of the bore 60; this may result in a slight bulge 64 in the portion of the tube that surrounds the circular edge 50*a*.

It should be recognized that in actual use, the plug 50 is under only a slight pressure due to the gas flowing into the tube 10 and into the burner nozzles. The deformation of the plug 50 in response to the force applied to the apex 50*b* provides both a seal and secure engagement between the plug and the tube end 12*a*. The engagement is sufficient to resist any force applied by the gas flowing in the tube.

In FIG. 8, the plug 50 is shown as substantially flat with only a slight outward protrusion of the apex 50*b*. It should be understood that the final shape of the plug 50 is related to the amount of force applied to the plug. It should be noted here that sufficient force especially if it's a reciprocating force, can be applied to the plug member 50 to completely flatten the plug 50 or, alternately, cause the apex 50*b* to move slightly "over center" with respect to the plane of the plug member so that it projects towards the interior of the tube.

Various methods can be used to apply the required force to the plug 50. In the preferred embodiment, and as shown in FIG. 8, a tool member 70 preferably in the form of a cylindrical punch having a flat end face 70*a* is inserted into the bore 60. In the preferred embodiment, the diameter of the punch is slightly less than the diameter D of the bore 60 in order to facilitate insertion and retraction of the tool member 70 from the bore 60. The tool 70 may be attached to a suitable force applying device, such as a press. Alternately, the tool 70 may form part of a reciprocating, impact mechanism, which reciprocates the punch in order to "hammer" the plug 50 order to effect the required deformation. Mechanisms for producing this reciprocating motion in a punch are well known and, for example, are used in riveting operations.

With the disclosed design, the tube 10 can be easily cleaned and/or painted/coated prior to insertion of the plug 50. Since both ends of the tube remain open, cleaning fluid or excess coating (i.e. paint) can be easily drained from the inside of the tube 10 prior to sealing of the tube end 12*a*.

It should be noted here that the shape of the tube 10 can vary substantially. The illustrated tube 10 should be considered, but an example of a tube configuration. The invention itself contemplates tubes of various shapes including tubes of both less and more complex configurations.

Although the invention has been described with a certain degree of particularity, it should be understood that those skilled in the art can make various changes to it without departing from the spirit or scope of the invention as hereinafter claimed.

I claim:

1. A method for sealing an end of a burner tube, comprising:

a) forming a stepped bore near the end of the burner tube;

b) inserting a cone-shaped plug element into said bore until a circular periphery of said plug element abuttably engages a step defined by said stepped bore, said circular periphery of said plug element having a diameter greater than an inside diameter of said step formed by the stepped bore;

c) applying a force to said plug element tending to cause its circular periphery to expand radially outwardly; and, d) applying sufficient force to said plug element to cause said circular periphery to expand radially outwardly until it sealingly engages the inside of said stepped bore.

2. The method of forming a burner tube set forth in claim 1, further comprising the step of forming bends in said tube prior to insertion of said plug element.

3. The method of claim 1, further comprising the step of forming openings in said tube through which a combustible gas is discharged, prior to insertion of said plug element.

4. A burner tube for use in a burner assembly, comprising:

a) a tube segment defining a stepped bore at an opened end of said tube segment;

b) a nonplanar plug member having a protruding portion extending towards an open end of said tube segment; and, c) said plug member having a circular periphery extended outwardly to sealingly engage an inside wall of said stepped bore, whereby said opened end of said tube segment is sealed.

5. The apparatus of claim 4, wherein said plug member is cone-shaped and includes a centrally positioned apex which is engageable by a force applying tool.

* * * * *